US009033359B2

(12) United States Patent
Favret et al.

(10) Patent No.: US 9,033,359 B2
(45) Date of Patent: May 19, 2015

(54) BINDING FOR A BOOT ON A GLIDING BOARD AND A GLIDING BOARD EQUIPPED WITH SUCH BINDING

(71) Applicant: SALOMON S.A.S., Metz-Tessy (FR)

(72) Inventors: Lionel Favret, Annecy (FR); Jean-Philippe Guex, Sillingy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/083,913

(22) Filed: Nov. 19, 2013

(65) Prior Publication Data

US 2014/0138936 A1 May 22, 2014

(30) Foreign Application Priority Data

Nov. 20, 2012 (FR) ..... 12 03118

(51) Int. Cl.

| | |
|---|---|
| ***A63C 9/00*** | (2012.01) |
| ***A63C 5/07*** | (2006.01) |
| ***A63C 5/075*** | (2006.01) |

(52) U.S. Cl.

CPC ... *A63C 9/00* (2013.01); *A63C 5/07* (2013.01); *A63C 5/075* (2013.01); *A63C 9/003* (2013.01); *A63C 2009/008* (2013.01)

(58) Field of Classification Search

USPC ..... 280/601, 607–609, 11, 11.3, 11.31, 280/11.33, 11.14, 613–614, 616–617, 624, 280/625–626, 623, 633–634

See application file for complete search history.

(56) References Cited

U.S. PATENT DOCUMENTS

| | | | | |
|---|---|---|---|---|
| 6,131,939 | A * | 10/2000 | Fels | 280/601 |
| 7,159,891 | B1 * | 1/2007 | Niggemann | 280/607 |
| 7,431,310 | B2 * | 10/2008 | Redor et al. | 280/11.14 |
| 7,661,695 | B2 * | 2/2010 | Miette | 280/623 |
| 7,828,303 | B2 * | 11/2010 | Girard et al. | 280/11.3 |
| 7,967,324 | B2 * | 6/2011 | Miette et al. | 280/618 |
| 8,662,524 | B2 * | 3/2014 | Girard et al. | 280/607 |

FOREIGN PATENT DOCUMENTS

| | | |
|---|---|---|
| WO | WO-00/10659 A1 | 3/2000 |

* cited by examiner

*Primary Examiner* — John Walters
*Assistant Examiner* — James Triggs
(74) *Attorney, Agent, or Firm* — Greenblum & Bernstein, P.L.C.

(57) ABSTRACT

A binding for a boot on a gliding board adapted to be used during a sporting activity involving gliding phases, the binding making it possible to attach the boot of a user in a first longitudinal position in relation to the gliding board. The binding includes a plate having at least one slide; a base adapted to be attached to the gliding board; at least one rail fixed to the base and cooperating with the slide, the plate being movable in translation along the rail and in both directions, in relation to the base between a maximum advance position in which the plate is in support against a first stop, and a maximum retraction position in which the plate is in support against a second stop; a damping mechanism damping the translational movement of the plate in both directions, in relation to the base, and which positions the plate by default in a central position in which the plate is located, along the rail, between the maximum advance position and the maximum retraction position.

18 Claims, 6 Drawing Sheets

3a
4a2
4a1
8a
6
3b
23
9c2
9c1
8b
4b2
4b1
F1
F2

BINDING FOR A BOOT ON A GLIDING BOARD AND A GLIDING BOARD EQUIPPED WITH SUCH BINDING

CROSS-REFERENCE TO RELATED APPLICATION

This application is based upon French Patent Application No. 12/03118, filed Nov. 20, 2012, the disclosure of which is hereby incorporated by reference thereto in its entirety, and the priority of which is claimed under 35 U.S.C. §119.

BACKGROUND

1. Field of the Invention

The present invention relates to the binding of a boot on a gliding board. In particular, the invention relates to an interface device between the structure used in binding the boot to the gliding board, as well as a gliding board in combination with such an interface device. More particularly, the invention relates to the practice of alpine skiing, in which the skier descends very steep slopes at high speed, with each foot affixed to a separate gliding board. In alpine skiing, the boots and the devices for binding the boots to the gliding boards are configured so that the front and rear of the boot are attached to the gliding board and substantially immobilized vertically in relation thereto.

2. Background Information

Gliding on snow, such as skiing, is a relatively old sport, and a number of products have been developed to make the practice ever more enjoyable, more efficient, and more accessible. New gliding techniques have appeared more recently and somewhat changed the rules of practice, but few have fundamentally challenged the principle of binding the boots of the user on the gliding board. In order to improve the safety of the users, so-called "safety bindings" have been developed, which provide for the release of the boot from the gliding board in the event of a fall. However, the known devices for affixing a boot to a gliding board are not optimal and their use is a source of discomfort for the users.

One of the sources of discomfort, and especially for alpine skiers, occurs at every turn. While moving in a straight line down the slope, the skier undergoes a deceleration when he/she initiates a turn. But the inertia of the body tends to unbalance the skier forward. Conversely, upon exiting a turn, the acceleration of the skis tends to unbalance the skier rearward. The skier must constantly counteract against these unbalance-causing forces.

The structure of a binding generally comprises at least one front retaining device referred to as the "toe piece". This is the case for all skiing practices, whether alpine skiing, cross-country skiing, ski touring, and even telemark skiing. In the case of alpine skiing, the structure of a binding also comprises a rear retaining device referred to as the "heel piece". The boot is inserted between the toe piece and the heel piece, these elements being capable of being fixed on a base, which may or may not be a common base, also referred to as an interface. Thus, the combined action of these two retaining devices makes it possible to longitudinally affix the boot to the gliding board. To block the movement of the boot along a direction, perpendicular to the sole of the gliding board and generally vertical during use of the gliding board, the toe piece and heel piece are each equipped with a stop mechanism acting on the boot.

The base to which the toe piece and heel piece are fixed is generally stationary in relation to the gliding board, so that the boot is fixedly held on the gliding board. In the case in which the toe piece and heel piece are fixed to a common base, i.e., the same base, a limited relative movement may be provided between the base and the ski to ensure that the base does not interfere with the bending of the ski. In general, one of the ends of the base, or the center thereof, is solidly fixed to the ski without possible relative movement with respect to the portion of the ski to which it is fixed, whereas the opposite ends are capable of sliding in relation to the ski when the ski bends. This arrangement is such that the base does not interfere with the bending of the ski, and it provides a ski for which the skier's foot is always stationary in relation thereto. Therefore, the terrain irregularities, if substantial, tend to unbalance the skier, as the effects of such irregularities are transmitted from the ski to the skier through the bindings.

The document WO-A-00/10659 and its family member U.S. Pat. No. 6,131,939 disclose a ski, the upper surface of which, opposite the gliding sole, is equipped with a base extending over the major portion of the length of the ski, and a central zone of which is provided to receive a device for binding a boot. The ski is provided with a longitudinal rail forming a slide with a complementary groove provided in the base. The base, in the area of its central zone, is fixed to the ski by screws. Thus, the ends of the base are movable in translation in relation to the ski, along the longitudinal direction of the ski. The ski and the base are curved in a direction perpendicular to the gliding sole of the ski, the concave side being turned downward. The front and rear ends of the ski comprise stops for limiting the movement of the ends of the base in relation to the ski, which are maneuverable between an unlocked position, in which the translational movement of the ends of the base in relation to the ski is authorized, and a locked position, in which the ends of the base are fixedly affixed to the ski. In the locked position, the base increases the stiffness of the ski in longitudinal bending. In the unlocked position, the sliding of the ends of the base in relation to the ski results in the base not opposing the longitudinal bending of the ski. However, whether in the locked or unlocked position, the skier's foot remains stationary in relation to the ski.

For a given ski, and once the safety bindings are mounted, the position of the foot of the skier in relation to the ski is fixed information. In general, ski manufacturers recommend a predetermined position for each ski model. This position is marked on the ski by a line referred to as the "boot center mounting point" because the ski boot also has a "boot center" reference mark in its middle. When mounting the ski bindings, or when the bindings are being adjusted by a specialized technician at the ski rental store, it is strictly required to have the "boot center" reference mark of the boot correspond to that of the ski.

On occasion, for a particular practice, a user can choose not to follow the recommendation of the manufacturer, but rather to mount his/her bindings so that the "boot center" reference mark of the boot either forward or rearward in relation to the reference mark of the ski. However, no device exists for displacing the ski bindings during practice, i.e., while skiing, e.g., such that the "boot center" point of the boot moves longitudinally in relation to the "boot center" point of the ski.

Furthermore, there are damping means positioned between the base and the skis, which are supposed to reduce the effects of irregularities in the terrain. For example, rubber plates are sometimes positioned to play this role. Unfortunately, the effect of these damping means is limited, as they act along a vertical direction.

Therefore, there exists a need to improve the practice of skiing by providing users with new equipment that improves performance and efficiency, while also improving comfort during use.

SUMMARY

In view of the foregoing, the invention overcomes the aforementioned drawbacks by providing a binding of a boot on a gliding board that makes it possible to reduce undesired movements of the skier caused by terrain irregularities, especially recessed or protruding areas along the slope or trail.

To this end, the invention provides a binding for a boot on a gliding board adapted to be used during a sporting activity involving gliding phases, the binding making it possible to attach the boot of a user in a first longitudinal position in relation to the gliding board, the binding comprising a plate provided to receive the boot, at least one device for retaining the boot to the plate, a sliding mechanism arranged between the plate and the gliding board enabling a longitudinal displacement of the plate in relation to the gliding board, the sliding mechanism moving the plate during the gliding phases so that the boot can shift longitudinally in relation to the first longitudinal position during the sporting activity.

With the invention, the boot is free to move back and forth when the skier encounters a pothole or a bump on the trail. A damping mechanism reduces the transmission of these disturbances to the skier's boot. Thus, the skier's unbalances caused by the terrain irregularities are reduced. When on even terrain once again, the damping mechanism assists the boot in quickly recovering a stable central position, thereby enabling the skier to easily regain balance.

The fixing of a ski boot according to the invention provides much tolerance for changes in terrain. Thus, when the gliding board passes over small bumps or is subject to sudden variations in the trail flatness, the skier's body does not have to move to maintain balance that is disturbed by the slight variations in speed and acceleration.

The invention also provides much ease and fluidity in steering the skis, as the skier is less sensitive to the imperfections of the trail.

Finally, the invention provides improved performance as the delays caused by the imperfections of the trail can be stored in the form of energy in the damping mechanism and they are subsequently returned to the gliding board.

In the context of the invention, a gliding board is a board to which the user attaches one of his/her boots to practice a sport, in which the board glides on the snow. Depending upon the type of practice, the gliding board can be a ski, which may be part of a pair of alpine skis, touring skis, cross-country skis, mini skis, or telemark skis.

According to advantageous but not essential aspects of the invention, such a binding can incorporate one or more of the following technical characteristics, taken in any technically feasible combination:

- the sliding mechanism enables the boot to move forward or rearward in relation to the first longitudinal position, or also forward and rearward;
- a first stop limits the forward movement of the plate, up to a maximum advance position, and a second stop limits the rearward movement of the plate, up to a maximum retraction position;
- the damping mechanism damps the movements of the plate in both directions and positions the plate in a stable position, in which the plate is located between the maximum advance position and the maximum retraction position;
- a base is fixedly assembled to the gliding board, the base comprising at least one rail, whereas the plate comprises at least one slide cooperating with the rail, a front retaining device and a rear retaining device being fixed to the plate;
- the displacement stroke of the boot between a maximum retraction position and a maximum advance position, measured parallel to the rail between the first stop and the second stop, is greater than 20 mm or, in a particular embodiment, greater than 30 mm. In fact, a stroke greater than 40 mm, in yet another particular embodiment, provides good results;
- the damping mechanism comprises a compression spring arranged in a housing comprising a lower portion fixedly assembled to the base and an upper portion fixedly assembled to the plate; and the upper portion is movable in translation, parallel to the rail, in relation to the lower portion;
- the longitudinal ends of each portion of the housing are formed by a wall perpendicular to the rails, and the length between the walls of each portion is equal to the free length of the spring;
- the plate comprises a front portion and a rear portion fixedly assembled to one another by at least one spacer;
- the base comprises a front portion and a rear portion, the longitudinal edges of which are each equipped with a rail, each rail cooperating with a slide fixedly assembled to the front portion or the rear portion of the plate;
- the slides are ball bearing slides, or comprise a material of low friction coefficient, such as polytetrafluoroethylene (Teflon®, for example);
- each rail is parallel to a longitudinal axis of the gliding board.

The invention also relates to a gliding board equipped with a binding as defined in the claims that follow.

BRIEF DESCRIPTION OF DRAWINGS

The invention will be better understood and other advantages thereof will appear more clearly in light of the following description of a ski equipped with a boot binding according to the invention, given by way of example, and with reference to the annexed drawings, in which.

DETAILED DESCRIPTION

Figure 1:
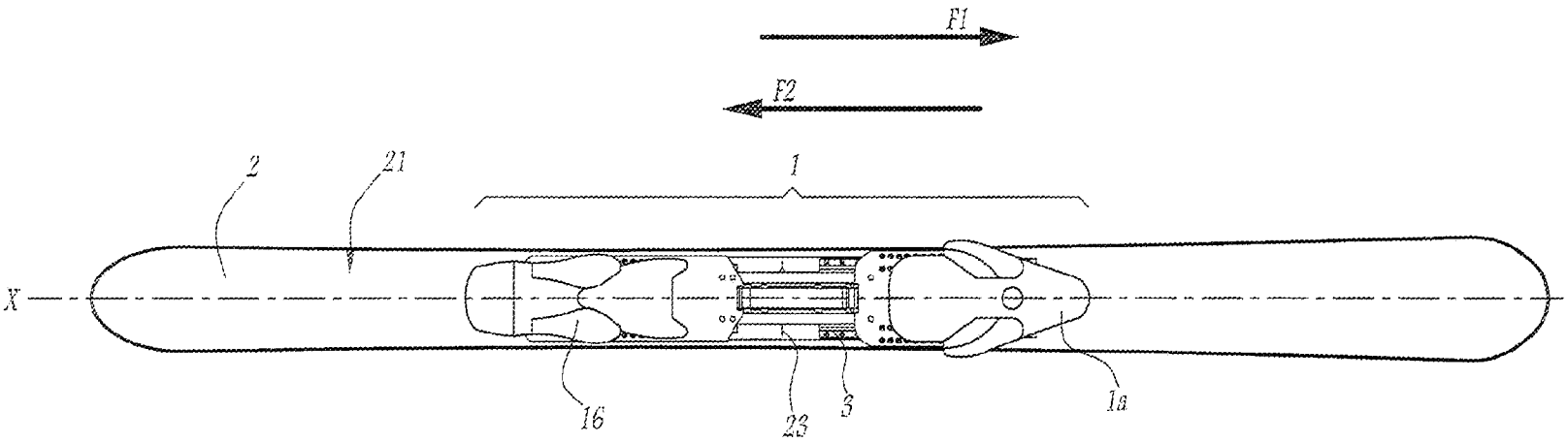
FIG. 1 is a top view of a gliding board equipped with a boot binding according to a first embodiment of the invention.

FIG. 1 shows a ski 2 on which a binding 1 is mounted, provided to attach a boot to the ski 2. The binding 1 comprises a front retaining device 1*a* commonly referred to as the "toe piece", and a rear retaining device 1*b* commonly referred to as the "heel piece". The toe piece and heel piece shown in FIG. 1 are specific to an "alpine ski". The invention advantageously applies to the practice of alpine skiing, whereby the boot is vertically immobilized in relation to the gliding board, i.e., to the ski 2. However, bindings fitted for respective ones of a touring ski, a telemark ski, and a cross-country ski are also within the scope of the invention. In these disciplines, the boot is not vertically immobilized relative to the gliding board/ski and can, for example, pivot about a transverse axis. In FIGS. 2-8, to facilitate an understanding of other structures, the toe piece 1*a* and heel piece 1*b* are not shown.

The ski 2 comprises a gliding surface 22, which is in contact with snow during use of the ski 2, as well as an upper surface 21, which is substantially parallel to the gliding surface 22 and to which the binding 1 is attached. The ski 2 extends along a median longitudinal axis X passing through the toe piece 1*a* and the heel piece 1*b*.

For convenience, the description is organized by taking into account that the term "front" refers to a direction generally parallel to the axis X, and in a direction F1 extending from the heel piece 1*b* to the toe piece 1*a*, that is to say, a direction facing to the right in the drawing figures, whereas the term "rear" refers to an opposite direction F2. The term "longitudinal" refers to a direction generally parallel to the axis X.

The terms "upper" and "top" refer to a direction generally parallel to the axis X and extending from the gliding surface 22 to the upper surface 21, that is to say, a direction facing the top portion of FIGS. 2 and 6-8, whereas the terms "lower" and "bottom" correspond to the opposite direction.

Figure 1A:
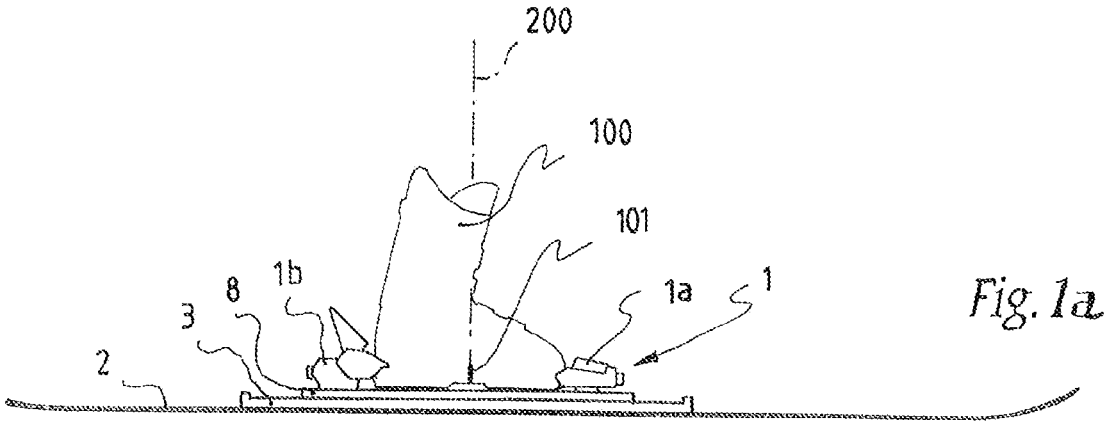
FIGS. 1*a*, 1*b*, 1*c* are schematic side views of the ski of FIG. 1.
Figure 1B:
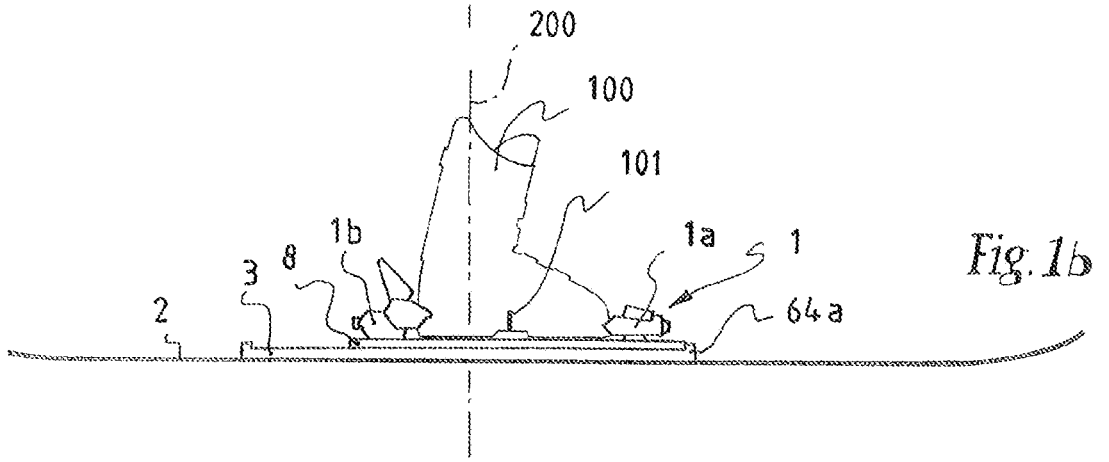
Figure 1C:
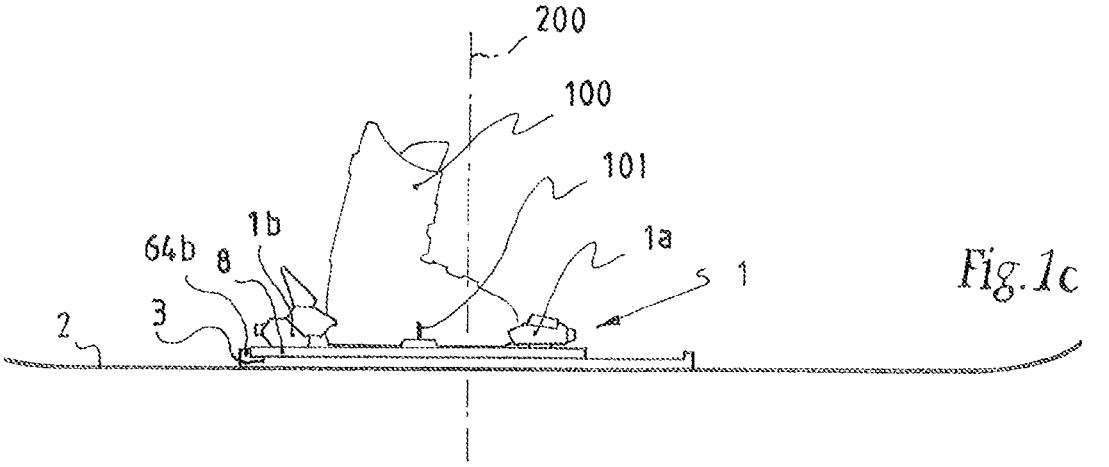

FIGS. 1*a*, 1*b*, 1*c* schematically show the functioning of a ski according to a first embodiment of the invention during a gliding phase, that is to say, while the skier is traveling down a ski slope.

The base 3 is affixed to the ski by screws, glue, or any equivalent expedient. The sliding mechanism enables the plate 8 to slide longitudinally in relation to the ski. The binding 1 is mounted on the plate. The boot 100, which is retained by the binding, can therefore slide longitudinally in relation to the ski.

In FIG. 1*a*, the plate is in a neutral intermediate position. This position corresponds, for example, to the central position recommended by the ski manufacturer. This central location is often referenced on the ski by a line 23 made on the ski (see FIG. 2). This line is in alignment with the fine chain line 200. A reference mark 101, corresponding to the middle of the boot, is referenced on the outer surface of the boot. In the neutral position, the reference mark 101 is in alignment with the central position of the ski, that is to say, directly above the line 23.

In FIG. 1*b*, the plate is moved forward until it comes into contact with a first stop 64*a*; the boot is then offset forward with respect to the line 23.

In FIG. 1*c*, the plate is moved rearward until it comes into contact with a second stop 64*b*; the boot is then offset rearward in relation to the line 23.

A damping mechanism, positioned between the base 3 and the plate 8, makes the rearward and forward movements less abrupt so as not to unbalance the skier. The damping mechanism also serves to return the plate to a stable central position, i.e., the so-called neutral position (see FIG. 1*a*).

Figure 2:
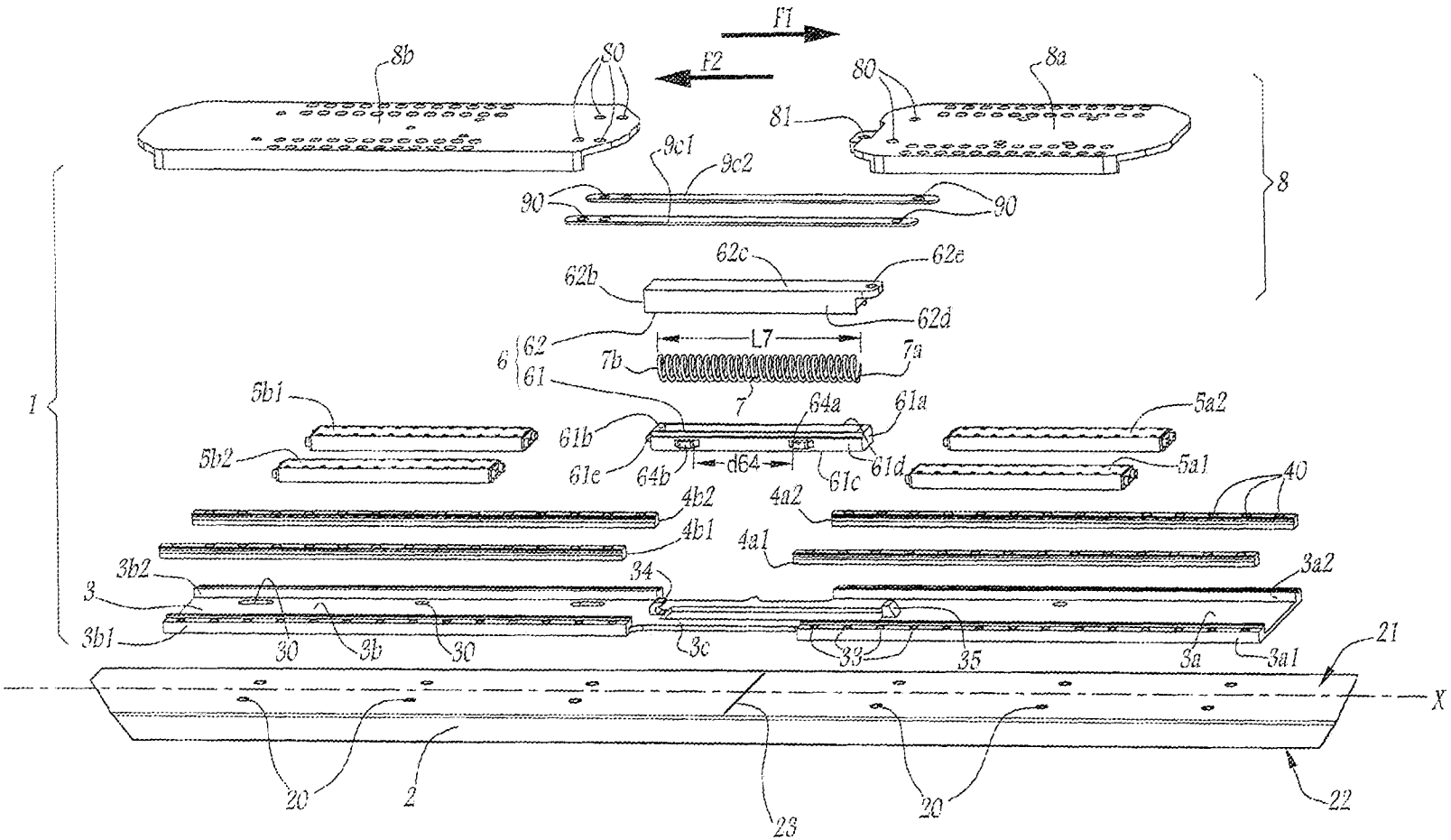
FIG. 2 is a partial exploded perspective view of the binding of FIG. 1, mounted on the ski.

FIG. 2, in an exploded view, shows a detailed construction of the binding according to the first embodiment of the invention. The base 3 is fixed to the ski 2 using screws, which cooperate with fixing holes 20 and 30 provided in the ski 2 and the base 3, respectively. Thus, the base 3 is fixedly assembled to the ski 2.

The base 3 is made in a rigid single piece and comprises a front portion 3*a*, a rear portion 3*b*, and a central portion 3*c* connecting the front portion 3*a* to the rear portion 3*b*.

The two longitudinal edges of the front portion 3*a* and rear portion 3*b* of the base 3 each comprise a strip 3*a*1, 3*a*2, 3*b*1, or 3*b*2 with increased thickness, parallel to the axis X. The two strips 3*a*1 and 3*a*2 or 3*b*1 and 3*b*2 of each portion 3*a* and 3*b* are separated by a distance approximately equal to the width of the ski 2. A row of holes 33 is made in each strip 3*a*1, 3*a*2, 3*b*1, or 3*b*2. A rail 4*a*1, 4*a*2, 4*b*1, or 4*b*2, provided with a row of complementary holes 40, is fixed to each excess thickness 3*a*1, 3*a*2, 3*b*1, or 3*b*2, using screws, not shown, which cooperate with the holes 40 of the rails 4*a*1, 4*a*2, 4*b*1, or 4*b*2, and with the holes 33 of the base 3. Thus, the rails 4*a*1, 4*a*2, 4*b*1, and 4*b*2 are fixedly assembled to the base 3 and are stationary in relation to the ski 2.

The binding 1 comprises a plate 8 comprised of a front portion 8*a*, a rear portion 8*b*, and two spacers 9*c*1 and 9*c*2 connecting the front portion 8*a* to the rear portion 8*b*. Screws are used to fix the ends of the spacers 9*c*1 and 9*c*2 to the portions 8*a* and 8*b* of the plate 8. The screws cooperate with holes 80 and 90 provided in the spacers 9*c*1 and 9*c*2 and in the portions 8*a* and 8*b* of the plate 8, respectively. The spacers 9*c*1 and 9*c*2 block the movements of the front portion 8*a* in relation to the rear portion 8*b* of the plate 8.

The toe piece 1*a* and heel piece 1*b* are fixedly assembled to the front portion 8*a* and rear portion 8*b*, respectively, of the plate 8, for example using screws.

Two slides 5*a*1 and 5*a*2, for example ball bearing slides, are fixedly assembled to the front portion 8*a* of the plate 8, for example using screws. Similarly, two slides 5*b*1 and 5*b*2 are fixedly assembled to the rear portion 8*b* of the plate 8. The slides 5*a*1, 5*a*2, 5*b*1, and 5*b*2 are parallel to the axis X, and each cooperates with one of the rails 4*a*1, 4*a*2, 4*b*1, and 4*b*2. Together, they constitute the mechanism for sliding the plate 8 in relation to the ski.

The plate 8 is therefore movable in translation, along the axis X, in both directions F1 and F2. More specifically, the plate 8 is movable in translation in a direction F1 toward the front, in a direction extending from the heel piece 1*b* to the toe piece 1*a*, and toward the rear in a direction F2 extending from the toe piece 1*a* toward the heel piece 1*b*.

A housing 6, elongated and aligned with the axis X, is interposed between the base 3 and the plate 8. The housing 6 comprises a lower portion 61 forming a hollow box open toward the top, and an upper portion 62 forming a hollow box open toward the bottom, that is to say, toward the lower portion 61.

Walls 61*a* and 61*b*, perpendicular to the axis X, demarcate the longitudinal front and rear ends, respectively, of the lower portion 61 of the housing 6. Similarly, walls 62*a* and 62*b*, perpendicular to the axis X, demarcate the longitudinal front and rear ends, respectively, of the upper portion 62 of the housing 6.

Each portion 61 and 62 of the housing 6 also comprises a bottom 61*c* or 62*c* and two longitudinal lateral walls 61*d* or 62*d*.

A compression spring 7 is arranged within the housing 6. The spring 7 has a free unloaded length L7, when not subject to any external mechanical action measured between a longitudinal front end 7*a* of the spring 7 and a longitudinal rear end 7*b* of the spring 7. The coils of the spring 7 have an outer diameter D7.

A length L61 of the inner volume of the lower portion 61 of the housing 6, measured parallel to the axis X, between the walls 61*a* and 61*b*, is equal to the length L62 of the inner volume of the upper portion 62 of the housing 6, measured parallel to the axis X, between the walls 62*a* and 62*b*. The length L7 of the spring 7 is equal to the lengths L61 and L62 of the housing 6.

The depth P61 of the inner volume of the lower portion 61 of the housing 6, measured perpendicular to the gliding surface 22 of the ski 2, is equal to the depth P62 of the inner volume of the upper portion 62 of the housing 6. The outer diameter D7 of the coils of the spring 7 is equal to the sum of the depths P61 and P62. In addition, the width of the inner volume of each portion 61*a* and 61*b* of the housing 6 is equal to the diameter D7 of the coils of the spring 7.

The spring 7 is thus confined in the housing 6 and is flush with the walls 61*a*, 61*b*, 62*a* and 62*b* of the housing 6, in the area of its ends 7*a* and 7*b*. It is also flush with the bottoms 61*c* and 62*c* toward the top and toward the bottom, as well as the lateral walls 61*d* and 62*d* on the sides.

The lower half of the spring 7 is housed in the lower portion 61 of the housing 6. The upper half of the spring 7 is housed in the upper portion 62 of the housing 6 and extends outward from the lower portion 61 of the housing 6.

The lower portion 61 is fixedly assembled to the base 3. The rear wall 61*b* of the lower portion 61 of the housing 6 is provided with a finger 61 cooperating with a hook 34 projecting from the central portion 3*c* of the base 3. The base 3 also comprises a stop 35 separate from the hook 34 by a distance equal to a total length L'61 of the lower portion 61 of the housing 6, measured between the surfaces of the walls 61*a* and 61*b* facing away from one another.

During assembly of the housing 6 with the base 3, the finger 61*b* is slipped into the hook 34 of the base, by maintaining the lower portion 61 of the housing 6 inclined in relation to the axis X. Then, the front end 61*a* of the lower portion 61 of the housing 6 is bent so as to position the front wall 61*a* against the stop 35 of the base 3.

The central portion 3*c* of the base 3 comprises a rectangular slot 37, the dimensions of which correspond to those of the bottom 61*c* of the lower portion 61 of the housing 6, so that when the lower portion 61 of the housing 6 is assembled to the base 3, the bottom 61*c* of the lower portion 61 of the housing 6 is in contact with the upper surface 21 of the ski 2.

The upper portion 62 of the housing 6 is fixedly assembled to the plate 8. In the area of the front wall 62*a* of the upper portion 62 of the housing 6, the bottom 61*c* is extended forward by a lug comprising a bore 62*e*. A screw passes through the hole 61 and through a hole 81 provided on a lug extending the front portion 8*a* of the plate 8 toward the rear.

The upper portion 62 of the housing 6 is movable in translation along the axis X, in relation to the lower portion 61. When the plate 8 slides forward or rearward in relation to the base 3 and to the ski 2, the upper portion 62 of the housing 6 follows the same movements as the plate 8, and the lower portion 61 of the housing 6 remains immovable in relation to the base 3 and the ski 2.

The upper surface 21 of the ski 2 comprises a median line 23 perpendicular to the axis X, which defines the middle of the ski 2, or rather the center of the dimension line. The median line 23 constitutes a reference mark for positioning the middle of the boot in relation to the ski 2, along the axis X. The central portion 3*c* of the base 3 comprises a slider 36, which defines the middle of the base 3. The slider 36 enables the operator mounting the binding 1 on the ski 2 to align the center of the binding 1 with the median line 23.

Conventionally, the median line 23 is not located exactly in the middle of the ski 2 but is offset slightly rearward. The position of the median line 23 varies depending upon the particular gliding practice, or discipline, considered. For example, in free-style skiing, the median line 23 is generally offset forwardly along the ski 2, compared to its position for a multipurpose ski. The position of this line 23 also depends on the dimension lines.

Figures 3, 4, 5:
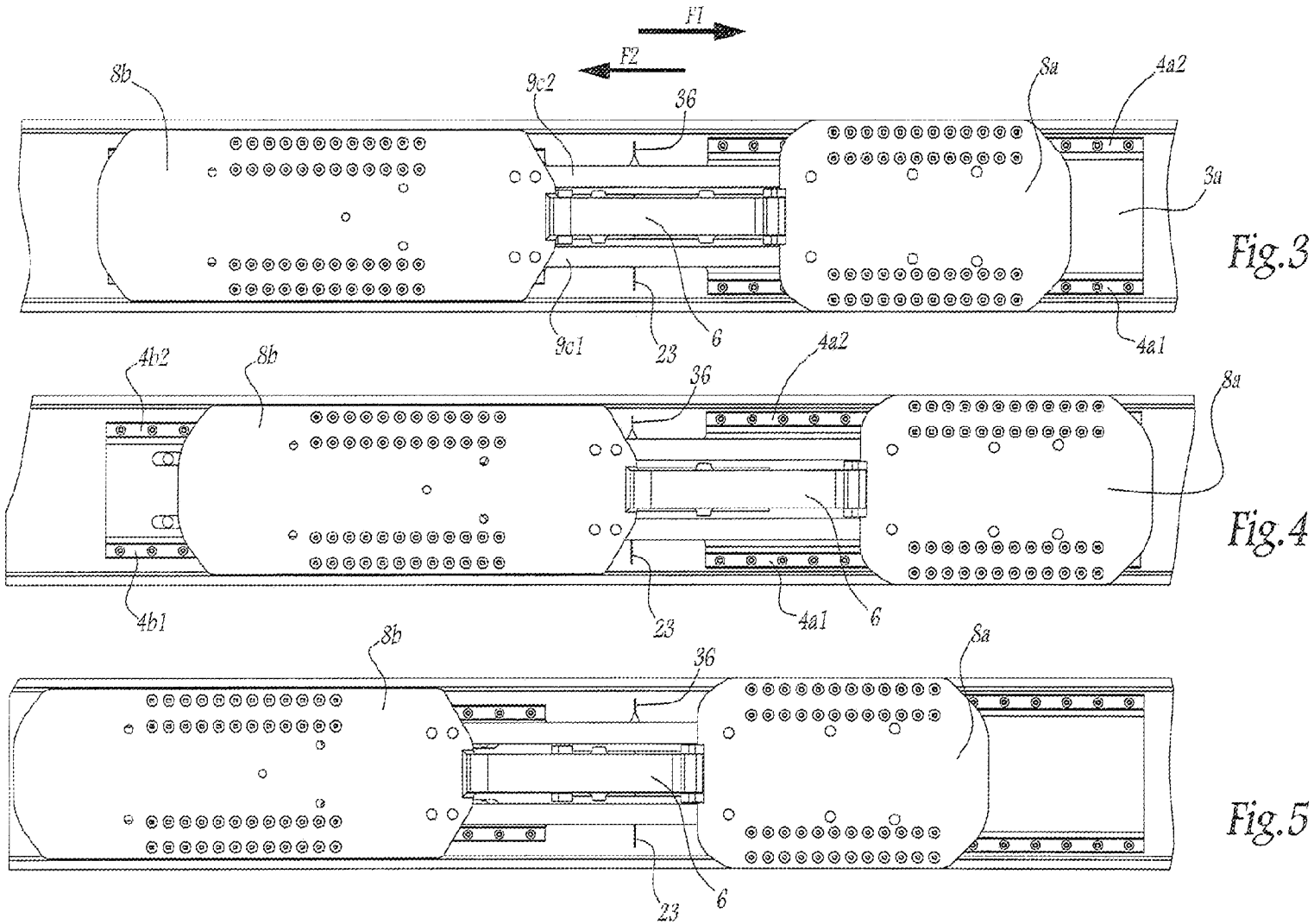
FIGS. 3, 4, and 5 are partial top views of the binding of FIG. 1, in a central position, a maximum advance position, and a maximum retraction position, respectively.
Figure 6:
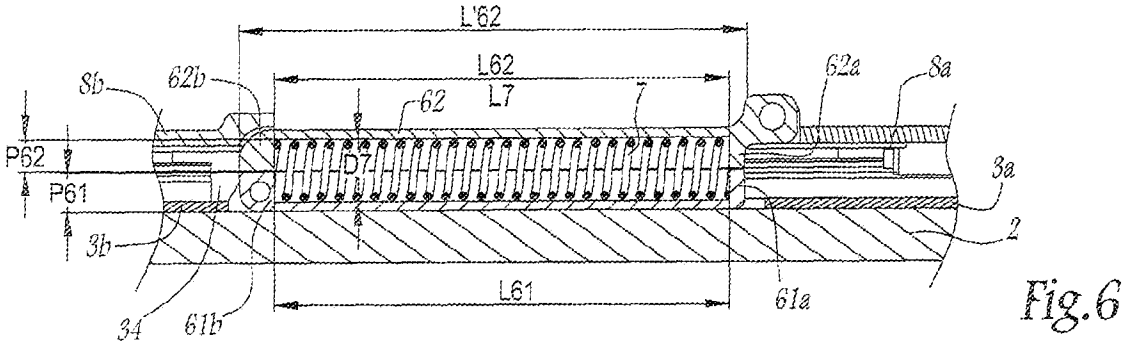
FIGS. 6, 7, and 8 are partial longitudinal cross sections of the binding along the axis X of FIG. 1, in the central position, maximum advance position, and maximum retraction position, respectively.
Figure 7:
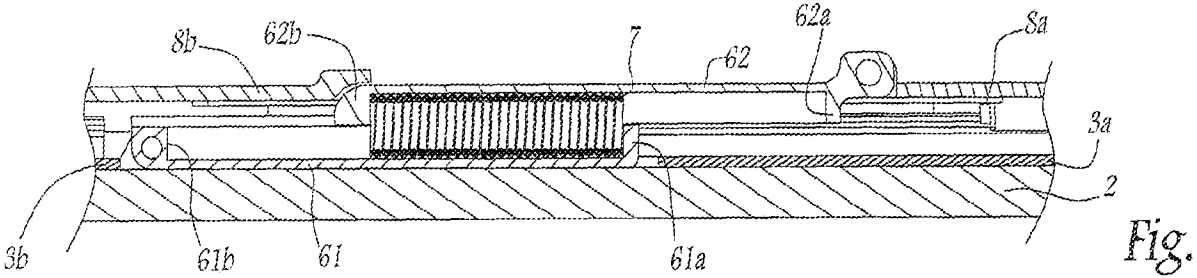
Figure 8:
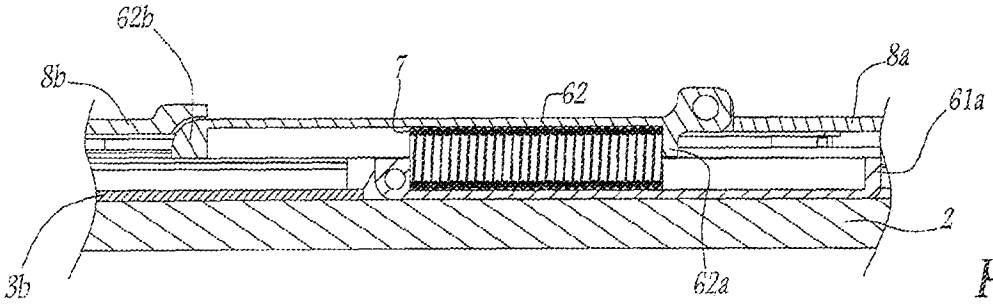

By default, when no external mechanical force acts on the ski 2 and on the binding 1, the binding 1 is in a central position, shown in FIGS. 3 and 6, in which the plate 8 and the middle of the boot are aligned with the median line 23 of the ski 2. The spring 7 tends to maintain the binding 1 in the central position by default.

When the skier encounters terrain irregularities, such as a bump or a lump of snow, the skier's inertia drives the plate 8 forward F1 in relation to the base 3 and to the ski 2, and the slides 5*a*1, 5*a*2, 5*b*1, 5*b*2 slide along the rails 4*a*1, 4*a*2, 4*b*1 and 4*b*2. At the same time, the upper portion 62 of the housing 6 slides in relation to the lower portion 61 and the spring 7 is compressed, thereby damping the advance or retraction movement of the plate 8. Upon passing the obstacle, the energy stored in the spring is restored and the plate gradually reassumes its place in the central position.

When the plate 8 slides forward F1 in relation to the base 3 and to the ski 2, the rear wall 62*b* of the upper portion 62 of the housing 6 pushes the rear end 7*b* of the spring 7. The spring 7 is compressed and its front end 7*a* takes support against the front wall 61*b* of the lower portion 61 of the housing 6. The translational movement of the plate 8 toward the front is limited by a front stop 64 (see FIG. 1*b*) against which a front projection of the plate abuts. The plate 8 is then in a maximum advance position in relation to the base 3 and to the ski 2, shown in FIGS. 1*b*, 4, and 7.

When the plate 8 slides rearward F2 in relation to the base 3 and to the ski 2, the front wall 62*a* of the upper portion 62 of the housing 6 pushes the front end 7*a* of the spring 7. The spring 7 is compressed and its rear end 7*b* takes support against the rear wall 61*b* of the lower portion 61 of the housing 6. The translational movement of the plate 8 toward the rear is limited by a rear stop 64*b* against which a rear projection of the plate abuts. The plate 8 is then in a maximum retraction position in relation to the base 3 and to the ski 2, shown in FIGS. 1*c*, 5, and 8.

In this way, the forward F1 or rearward F2 movements of the skier are reduced due to the spring 7, which dampens the displacements of the boots and prevents the skier from being unbalanced.

The center position is intermediate in relation to the maximum advance and retraction positions. Along the axis X, the position of the plate 8 in relation to the base 3 is located between the position of the plate 8 in the maximum advance position of FIGS. 4 and 7, on the one hand, and the position of the plate 8 in the maximum retraction position of FIGS. 5 and 8, on the other hand.

Once the skier has steered past the terrain irregularities, which tend to cause the skier to become unbalanced, the spring 7 expands and moves the plate 8 into the central position, thereby helping the skier to regain his/her equilibrium position.

Apart from any terrain irregularity, the plate can also move back and forth and vice versa depending upon the steering of the gliding board. For example, in the case of a pair of alpine skis, the plate moves forward and the damping mechanism stores energy when the ski initiates a turn. The return of this energy will have the effect of moving the plate rearward, beyond the central position. Thus, the skier is less unbalanced by the decelerations and accelerations to which he/she is subject.

The use of a ball bearing slide makes it possible to limit friction during translational movement of the plate 8, thereby improving the damping and the return of the plate 8 into the central position.

The stiffness of the spring 7 can be selected as a function of the weight of the skier. The return force of the spring 7 varies linearly as a function of the displacement of the plate 8.

The spring 7 and the housing 6 form a member for damping the longitudinal movement of the plate 8. Alternatively, the spring 7 and the housing 6 can be replaced with another damping member. For example, it may be a hydraulic damper. Possibly, the damping member may include a damper, the return force of which varies linearly with the speed of the plate 8.

The maximum displacement stroke of the plate 8 in relation to the base 3 is equal to the distance separating the front stop 64*a* from the rear stop 64*b*, from which the distance separating the front and rear projections provided beneath the plate 8 is subtracted. In practice, the displacement stroke ranges between 20 mm and 140 mm or between 30 mm and 100 mm. In the embodiment described in FIGS. 1-8, the total maximum displacement stroke is substantially equal to 80 mm. From the central position, the plate can move 40 mm forward and 40 mm rearward.

In the example described above, the gliding board is a ski adapted to be used in pairs. Alternatively, the board can be a snowboard, a mono-ski, or another type of gliding board.

In an alternative embodiment, the front portion 8*a* of the plate 8 is connected to the rear portion 8*b* by a single spacer. Alternatively, the plate 8 is made in a single piece.

Figure 9A:
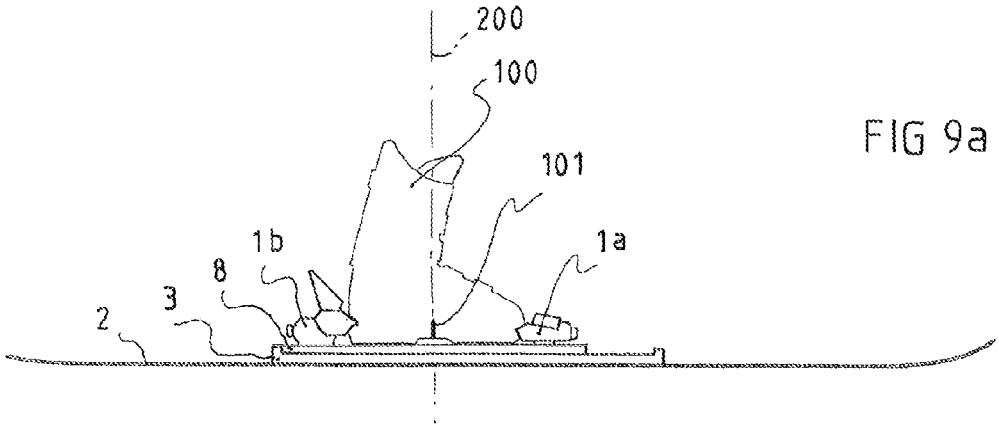
FIGS. 9*a* and 9*b* are schematic side views of a ski according to a second embodiment of the invention.
Figure 9B:
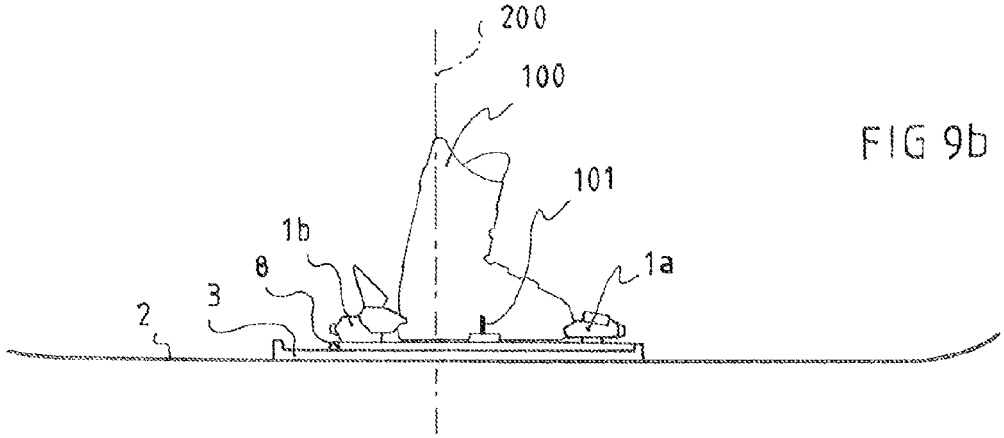

FIGS. 9*a* and 9*b* schematically show a second embodiment of the invention, in which the plate 8 carrying the bindings can slide freely only forward in relation to the ski. When it is not subject to a force directed forward, it is in its equilibrium position which corresponds to the position recommended by the ski manufacturer (FIG. 9*a*).

When subject to a longitudinal forward force, it slides forward. If the force is very substantial, it will reach the advanced position shown in FIG. 9*b*.

A gliding board equipped with such a binding has a behavior that facilitates its entry into the curve.

In an alternative embodiment, not shown, the base 3 is positioned on the ski so that it is the most advanced position of the plate that constitutes the stable equilibrium position. In such a case, the plate can slide only rearward. A gliding board thus equipped tends to accelerate out of the turn.

In the context of the invention, the characteristics of the various alternative embodiments can be combined, at least partially.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A binding for a boot on a gliding board adapted to be used during a sporting activity having gliding phases, said binding structured and arranged to attach the boot of a user in a first longitudinal position in relation to the gliding board, said binding comprising:

a plate;

at least one boot-retaining device structured and arranged to retain the boot on the plate;

a sliding mechanism arranged between the plate and the gliding board, when mounted on the gliding board, enabling a longitudinal movement of the plate in relation to the gliding board;

the sliding mechanism moving the plate during the gliding phases so that the boot moves in relation to the first longitudinal position during the sporting activity.

2. A binding according to claim 1, further comprising:

a damping mechanism for damping the longitudinal movements of the plate.

3. A binding according to claim 1, wherein:

the sliding mechanism enables the boot to move forward or rearward in relation to the first longitudinal position.

4. A binding according to claim 1, wherein:

the sliding mechanism enables a displacement stroke of the plate greater than 20 mm.

5. A binding according to claim 1, wherein:

the sliding mechanism enables a displacement stroke of the plate greater than 40 mm.

6. A binding according to claim 2, wherein:

a first stop limits forward movement of the plate up to a maximum advance position;

a second stop limits rearward movement of the plate up to a maximum retraction position.

7. A binding according to claim 6, wherein:

the damping mechanism dampens movements of the plate in both forward and rearward directions and positions the plate in a stable position in which the plate is located between the maximum advance position and the maximum retraction position.

8. A binding according to claim 1, further comprising:

a base structured and arranged to be fixedly assembled to the gliding board;

the base comprising at least one rail;

the plate comprising at least one slide cooperating with the rail.

9. A binding according to claim 2, wherein:

the damping mechanism comprises a compression spring arranged in a housing comprising a lower portion fixedly assembled to the base and an upper portion fixedly assembled to the plate;

the upper portion is movable in translation, parallel to the rail, in relation to the lower portion.

10. A binding according to claim 9, wherein:

longitudinal ends of each of the lower and upper portions of the housing are formed by a wall perpendicular to the rails;

the length between the walls of each portion is equal to a free length of the spring.

11. A binding according to claim 1, wherein:

the plate comprises a front portion and a rear portion fixedly assembled to one another by at least one spacer.

12. A binding according to claim 8, wherein:

the base comprises a front portion and a rear portion, the longitudinal edges of each of the front and rear portions being provided with a rail, each rail cooperating with a slide fixedly assembled to the front portion or the rear portion of the plate.

13. A binding according to claim 1, wherein:

the slides are ball bearings slides.

14. A binding according to claim 1, wherein:

each of the rails is parallel to a longitudinal axis of the gliding board.

15. A binding according to claim 1, wherein:

the boot-retaining device is structured and arranged to retain the boot on the plate and to vertically immobilize the boot in relation to the gliding board.

16. A binding according to claim 1, wherein:

a front retaining device and a rear retaining device are attached to the plate.

17. An assembly comprising:

a gliding board structured and arranged to be used during a sporting activity having gliding phases;

a binding structured and arranged to attach a boot of a user in a first longitudinal position in relation to the gliding board, said binding comprising:

a plate;

at least one boot-retaining device to retain the boot on the plate;

a sliding mechanism arranged between the plate and the gliding board, when mounted on the gliding board, enabling a longitudinal movement of the plate in relation to the gliding board;

the sliding mechanism moving the plate during the gliding phases so that the boot moves in relation to the first longitudinal position during the sporting activity.

18. An assembly comprising:

a pair of gliding boards, each of the pair being structured and arranged to be used concurrently by a user during a sporting activity having gliding phases;

a pair of boot-retaining bindings, the pair of bindings being structured and arranged to attach respective ones of a pair of boots of a user in a first longitudinal position in relation to respective ones of the gliding boards, each of said bindings comprising:

a plate;

at least one boot-retaining device to retain the boot on the plate;

a sliding mechanism arranged between the plate and a respective gliding board, when mounted on said gliding board, enabling a longitudinal movement of the plate in relation to said gliding board;

the sliding mechanism moving the plate during the gliding phases so that the boot moves in relation to the first longitudinal position during the sporting activity.

* * * * *